United States Patent [19]

Brodsky

[11] 4,384,649

[45] May 24, 1983

[54] DISPENSING PACKAGE

[75] Inventor: Louis Brodsky, Parlin, N.J.

[73] Assignee: E. R. Squibb & Sons, Inc., Princeton, N.J.

[21] Appl. No.: 215,211

[22] Filed: Dec. 11, 1980

[51] Int. Cl.[3] ..... B65D 83/04; B65D 85/56; B65D 65/26

[52] U.S. Cl. ..... 206/538; 206/532; 206/603

[58] Field of Search ..... 206/531, 532, 538, 484, 206/484.2, 528, 529, 530, 533, 534, 534.1, 534.2, 535, 536, 539, 603

[56] References Cited

U.S. PATENT DOCUMENTS 3,054,503 9/1962 Hartman et al. ..... 206/531
3,921,804 11/1975 Tester ..... 206/531

FOREIGN PATENT DOCUMENTS 2552812 6/1977 Fed. Rep. of Germany ..... 206/532

*Primary Examiner*—William T. Dixson, Jr.
*Assistant Examiner*—Brenda J. Ehrhardt
*Attorney, Agent, or Firm*—Lawrence S. Levinson; Donald J. Barrack

[57] ABSTRACT

A medicament dispensing package comprising a blister pack and cover, and an outer shell, wherein the blister pack has multiple pockets for receiving medicament, and the outer shell has means for sealing the cover around each pocket of the blister pack.

11 Claims, 9 Drawing Figures

DISPENSING PACKAGE

BACKGROUND OF THE INVENTION

Medication in solid form, i.e., tablets or capsules, is sometimes dispensed to patients in packages which contain individually sealed compartments designed to hold a single dose of medication. Such a package is exemplified by the disclosure of Tester, U.S. Pat. No. 3,921,804, issued Nov. 25, 1975.

Packages of this type are readily labeled and serve as a reminder to patients of whether or not they have taken a particular dose of their medicine. Furthermore, packages of this type provide for the handling of only a single dose of medicine at any given time, thus minimizing the risk of contamination.

BRIEF DESCRIPTION OF THE INVENTION

It is an object of this invention to provide a package for dispensing solid medicaments which protects the medicament from contamination by dirt or other foreign matter.

It is a further object of this invention to provide a package for dispensing solid medicaments (e.g., tablets, capsules or the like) whereby individual doses of the medicament (or of various medicaments) can be segregated from each other and can be removed from the package by the use of small amounts of pressure which can be exercised by a person's finger.

The package of this invention comprises two novel components. The first component is a blister pack comprising multiple pockets for receiving medicament, each of said pockets being substantially surrounded by a raised rim on the upper surface of the pack, said raised rim coinciding with an indentation of the lower surface, and further comprising a cover. The second component is an outer shell comprising a top and bottom part, each containing openings that are aligned with each other and sized and spaced to conform to the pockets of one or more blister packs; the bottom part further comprising an erect circular wall surrounding each opening, said wall mating with the indentation of the lower surface of the blister pack; and the top part of which further comprises a shoulder surrounding each opening and surrounding each shoulder a cutting edge.

DETAILED DESCRIPTION OF THE INVENTION

Figure 1:
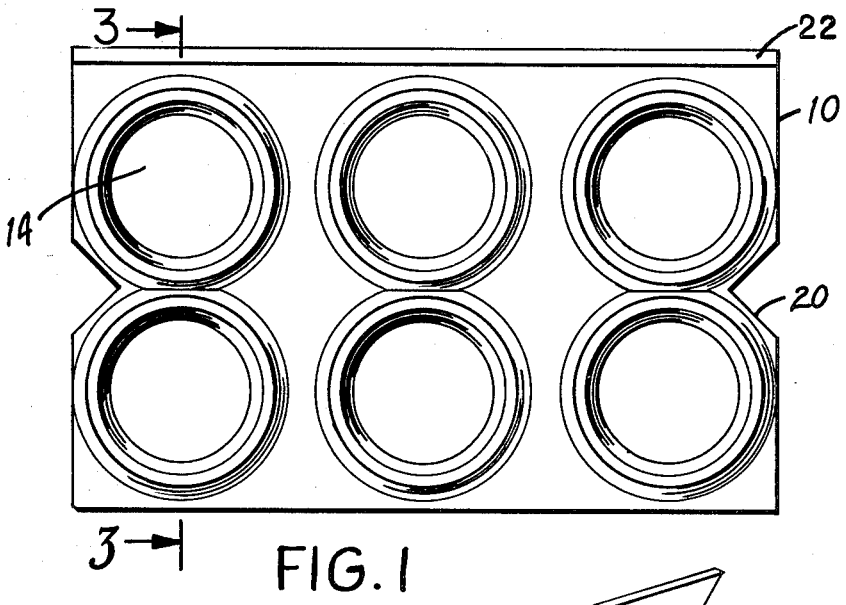
FIG. 1 is a plan view of an embodiment of a blister pack of this invention.
Figure 2:
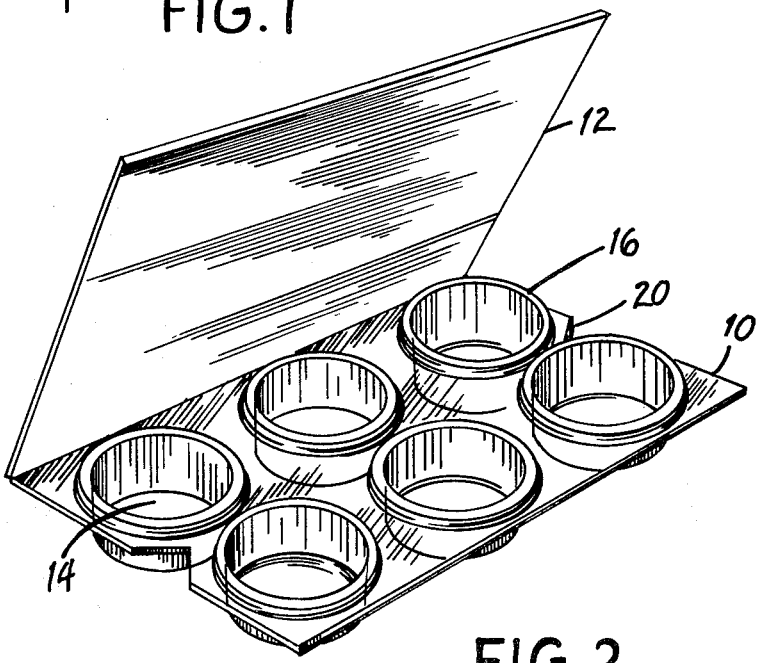
FIG. 2 is a perspective view of an embodiment of a blister pack of this invention with cover attached.
Figure 3:
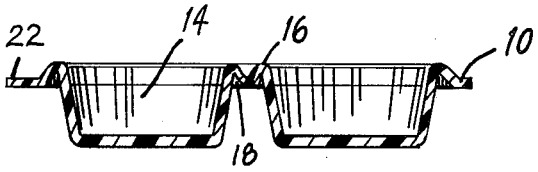
FIG. 3 is a cross-sectional view of an embodiment of a blister pack of this invention along line 3—3 of FIG. 1.

Referring to the drawings which describe specific embodiments of this invention, the dispensing package comprises a blister pack 10 with cover 12 having a plurality of pockets 14 for receiving solid medicament. The cover 12 can be separate from the blister pack 10 or may be attached thereto in a manner that will not hamper insertion of the medicament into the pockets 14 of the blister pack 10.

The blister pack 10 is preferably formed from a thin plastic sheet material, most preferably a clear plastic. The cover 12 is preferably made of a metal foil material, but can also be made of other materials such as plastics. The blister pack 10 will preferably have a seal area 22 to facilitate sealing of the cover 12.

Each pocket 14 is substantially surrounded by a raised rim 16. As will be described more fully hereinafter, the cutting edge 52 of the outer shell 50, will cut the cover 12 of the blister pack 10 and force fit it around the raised rim 16 of the pocket 14 sealing the medicament in the pocket 14.

Conforming to the raised rim 16 on the upper surface of the blister pack 10 is an indentation 18 on the lower surface of the blister pack 10. As will be described more fully hereinafter, the indentation 18 on the lower surface of the blister pack 10 mates with the erect circular wall 54 of the outer shell 50.

Figure 7:
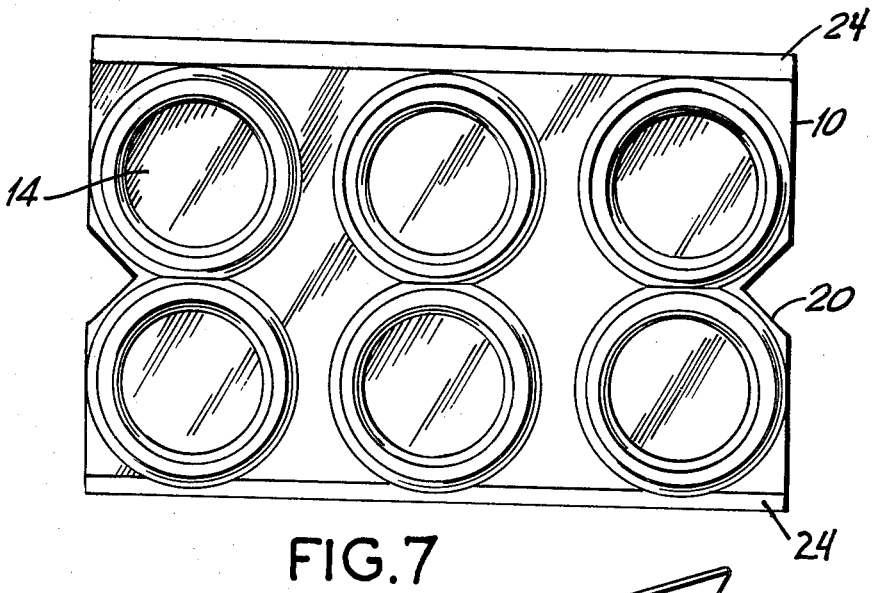
FIG. 7 is a plan view of another embodiment of a blister pack of this invention.
Figure 8:
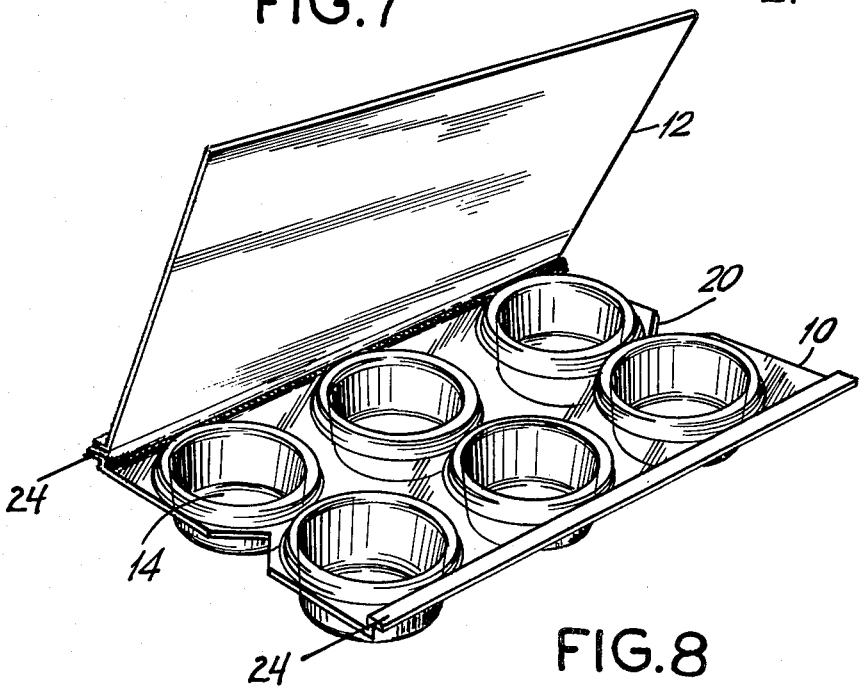
FIG. 8 is a perspective view of another embodiment of a blister pack of this invention with cover attached.

The blister pack 10 shown in FIG. 7 and FIG. 8 represents a preferred embodiment of this invention. Shoulders 24 along each of the longitudinal edges of the blister pack 10 may be raised so that they are planar with the raised rims 16 surrounding each pocket 14. The shoulders 24 facilitate sealing of the cover 12, and also (if the blister pack is vacuum formed from plastic) facilitate manufacturing.

The second component of this invention is an outer shell 50 comprising a top part 58 and a bottom part 60. Both the top 58 and bottom 60 parts of the outer shell 50 contain a plurality of openings 62 that are aligned with each other and sized and spaced to conform to the pockets 14 of the blister pack 10. It is preferred that the top 58 and bottom 60 parts of the outer shell be hinged along one edge, most preferably a longitudinal edge. It is also preferred that the outer shell 50 include means for retaining the top 58 and bottom 60 parts in a closed position. Exemplary means are aperture 64 and stud 66. Of course, it makes no difference whether the stud 66 is attached to the top 58 or bottom 60 part of the outer shell 50. When this closure means is used for the outer shell 50, the blister pack will preferably contain cut-outs 20 aligned with the studs 66.

The outer shell 50 can be made of a variety of materials such as polypropylene, polyethylene, polystyrene, polycarbonate or the like. Preferably polypropylene, a relatively strong material will be used, thus providing the option of reusing the outer shell 50.

The bottom part 60 of the outer shell 50 has an erect circular wall 54 surrounding each of the openings 62. The top part 58 of the outer shell 50 has a shoulder 68 substantially surrounding each of the openings 62. The width of the shoulder 68 is approximately equal to the width of the circular wall 54.

Figure 4:
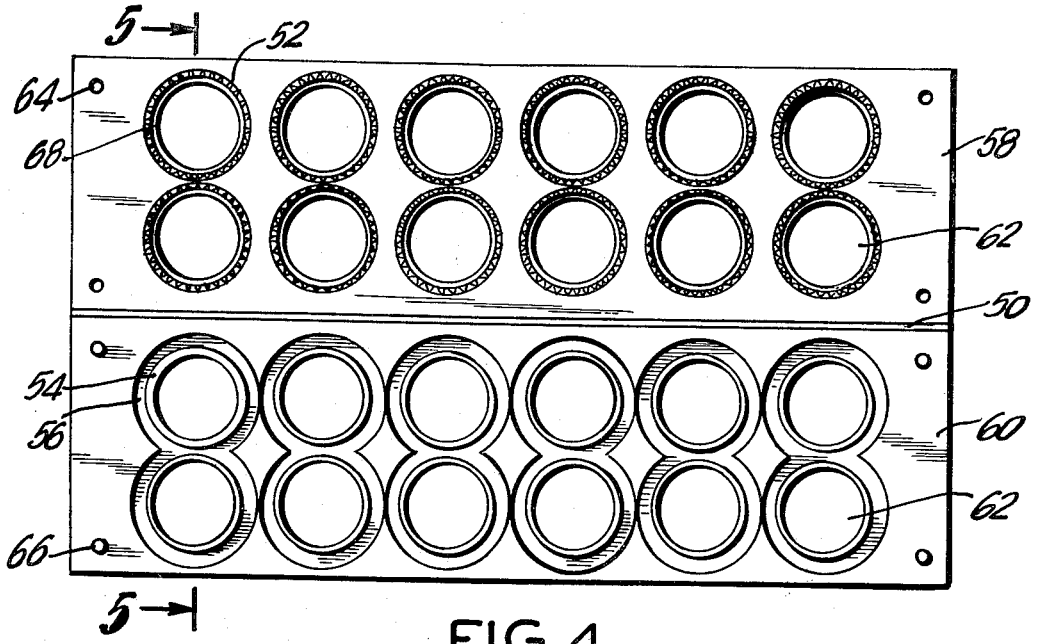
FIG. 4 is a plan view of an embodiment of the outer shell of the package of this invention in the fully open position.
Figure 5:
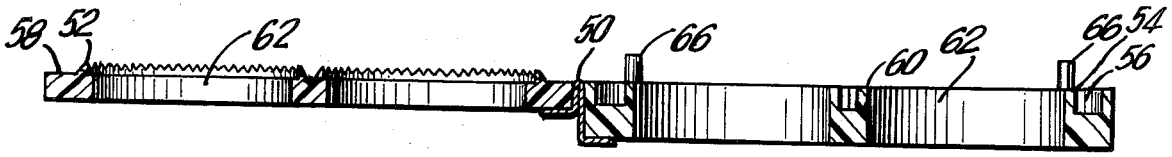
FIG. 5 is a cross-sectional view of an embodiment of the outer shell of the package of this invention along line 5—5 of FIG. 4.
Figure 9:
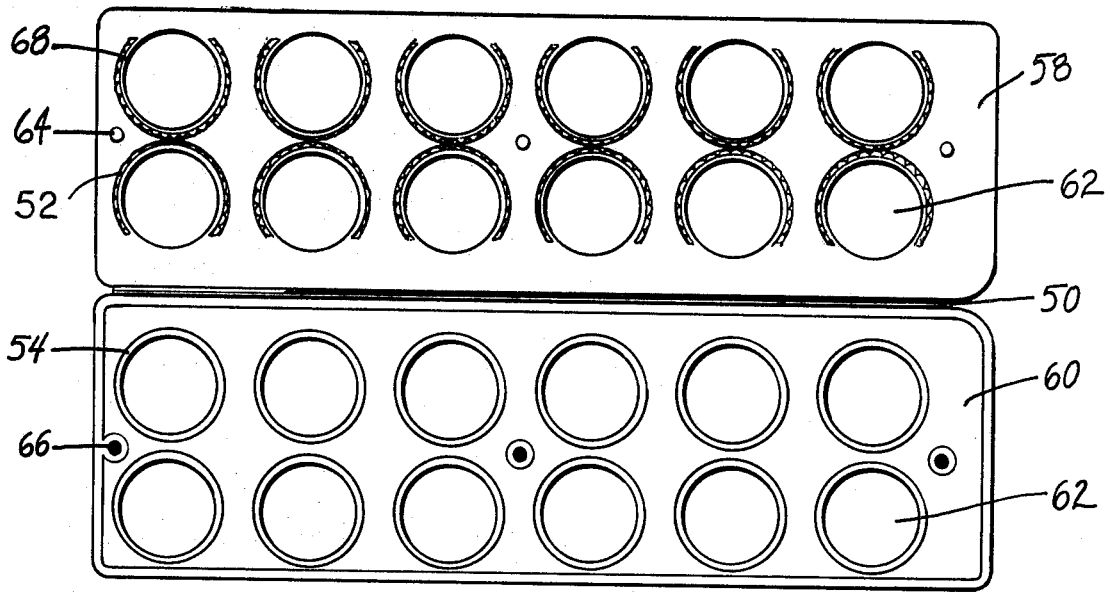
FIG. 9 is a plan view of another embodiment of the outer shell of the package of this invention in the fully open position.

Surrounding each shoulder 68 is a cutting edge 52. Preferably the cutting edge will be in the form of teeth-like projections. The embodiment of FIG. 4 has teeth-like projections 52 and shoulder 68 totally surrounding each opening 62 and is appropriate for use with the blister pack 10 of FIG. 1. The embodiment of FIG. 9 has teeth-like projections 52 and shoulder 68 substantially surrounding each opening 62 and is appropriate for use with the blister pack 10 of FIG. 8, i.e., a blister pack 10 having shoulders 24 raised so that they are planar with the raised rims 16 surrounding each pocket 14.

Figure 6:
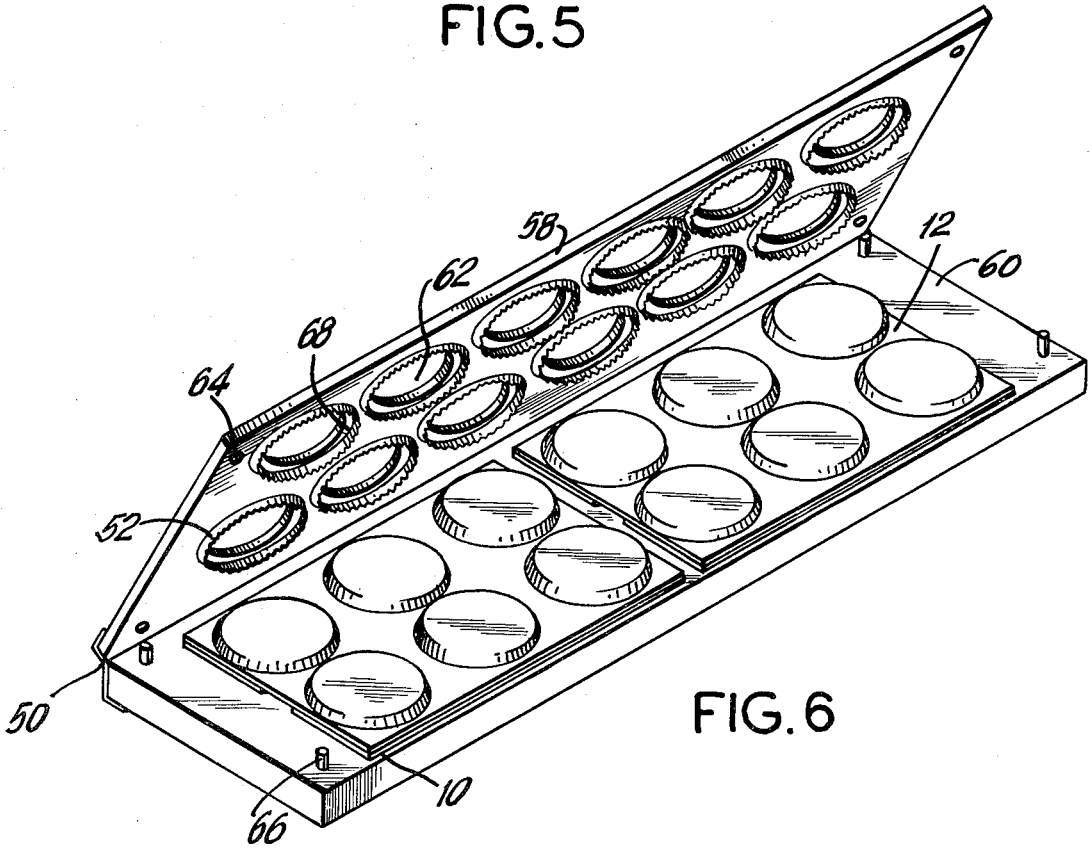
FIG. 6 is a perspective view of an embodiment of the package of this invention comprising blister packs and outer shell.

Each of the components of the package of this invention will most conveniently be separately supplied to people responsible for dispensing medicine. As described above, the outer shell 50 of the package is preferably reusable and the blister pack with cover (10 and 12) are preferably disposable. The need will exist, therefore, for far more blister packs with covers (10 and 12) than outer shells 50. Outer shells 50 can be supplied in sizes to hold one or more blister packs. FIG. 6 illustrates the use of two blister packs in a single outer shell. The practitioner of this invention will, of course, realize that blister packs and outer shells can be supplied in various relative sizes to satisfy the differing needs of pharmacists and other professionals who will utilize the package of this invention.

The pharmacist will fill the pockets 14 of the blister pack 10 and he may, optionally, seal the cover 12 around the edges of the blister pack 10. Sealing can be accomplished using known heat sealing techniques. After filling and covering the blister pack the pharmacist will insert the blister pack and cover (10 and 12) into the outer shell 50. Closing the outer shell 50 will cause the cutting edge 52 to contact the blister pack cover 12 and cut the cover 12 material forming a seal around the raised rim 16 of each pocket 14.

As used in this specification, the expression "substantially surrounding" includes totally surrounding.

What is claimed is:

1. A blister pack comprising multiple pockets for receiving medicament, each of said pockets being substantially surrounded by a raised rim on the upper surface of the pack, said raised rim coinciding with an indentation of the lower surface.

2. A blister pack in accordance with claim 1 further comprising a metal foil cover.

3. A blister pack in accordance with claim 1 having parallel longitudinal edges and further comprising raised shoulders along said longitudinal edges, said raised shoulders being planar with the raised rims substantially surrounding the pockets.

4. A shell for sealing and containing medicament dispensing blister packs comprising a top and bottom part, each containing openings that are aligned with each other and sized and spaced to conform to the pockets of one, or more, blister packs, the bottom part further comprising an erect circular wall surrounding each opening, and the top part comprising a shoulder substantially surrounding each opening, said shoulder being approximately equal in width to the erect circular wall, and surrounding each shoulder a cutting edge.

5. A shell in accordance with claim 4 wherein the erect circular wall is the inner wall of a channel surrounding each opening.

6. A shell in accordance with claim 4 wherein the cutting edges are in the form of teeth-like projections.

7. A medicament dispensing package comprising:

(i) as a first component one, or more, blister packs and covers, said blister packs having a plurality of pockets for receiving medicament, each of said pockets being substantially surrounded by a raised rim on the upper surface of the pack, said raised rim coinciding with an indentation of the lower surface; and (ii) as a second component an outer shell comprising a top and bottom part, each containing openings that are aligned with each other and sized and spaced to conform to the pockets of one, or more, blister packs, the bottom part further comprising an erect circular wall surrounding each opening, said wall mating with the indentation of the lower surface of a blister pack, and the top part comprising a shoulder substantially surrounding each opening, said shoulder being approximately equal in width to the erect circular wall, and surrounding each shoulder a cutting edge.

8. A medicament dispensing package in accordance with claim 7 wherein the top and bottom parts of the outer shell are hinged along one edge.

9. A medicament dispensing package in according with claim 7 wherein the outer shell further comprises means for retaining the top and bottom parts in the closed position.

10. A medicament dispensing package in accordance with claim 9 wherein the securing means is one or more studs and apertures.

11. A medicament dispensing package in accordance with claim 7 wherein the cutting edges of the outer shell are in the form of teeth-like projections.

* * * * *

UNITED STATES PATENT AND TRADEMARK OFFICE

CERTIFICATE OF CORRECTION

PATENT NO. : 4,384,649

DATED : May 24, 1983

INVENTOR(S) : Louis Brodsky

It is certified that error appears in the above—identified patent and that said Letters Patent is hereby corrected as shown below:

On the title page, the assignee should read:

-- Surgicot, Inc., Smithtown, New York --.

Signed and Sealed this

*Twenty-third* Day of *August 1983*

[SEAL]

*Attest:*

GERALD J. MOSSINGHOFF

*Attesting Officer*

*Commissioner of Patents and Trademarks*